United States Patent [19]

Jahme

[11] Patent Number: 4,792,132

[45] Date of Patent: Dec. 20, 1988

[54] SHEET FEEDER AND INVERTER APPARATUS FOR SHEET-PROCESSING MACHINES, PREFERABLY FOR TWO OFFSET PRINTING MACHINES DISPOSED IN TANDEM

[75] Inventor: Hans J. Jahme, Weisbaden, Fed. Rep. of Germany

[73] Assignee: Neue Rotoprint GmbH, Berlin, Fed. Rep. of Germany

[21] Appl. No.: 16,572

[22] Filed: Feb. 19, 1987

[30] Foreign Application Priority Data

Feb. 20, 1986 [DE] Fed. Rep. of Germany ..... 3605535

[51] Int. Cl.[4] ..... B65H 5/02

[52] U.S. Cl. ..... 271/186; 271/204; 271/291

[58] Field of Search ..... 271/186, 291, 204; 101/183

[56] References Cited

U.S. PATENT DOCUMENTS

| | | | |
|---|---|---|---|
| 3,946,669 | 3/1976 | Johne | 271/186 X |
| 4,569,284 | 2/1986 | Witczak | 271/186 X |
| 4,669,715 | 6/1987 | Jeschke | 271/186 |

FOREIGN PATENT DOCUMENTS

| | | |
|---|---|---|
| 618260 | 8/1935 | Fed. Rep. of Germany . |
| 968861 | 3/1958 | Fed. Rep. of Germany . |

*Primary Examiner*—Richard A. Schacher

*Attorney, Agent, or Firm*—Cushman, Darby & Cushman

[57] ABSTRACT

A sheet feeder and invertor apparatus for sheet-processing machines for selective operation with or without inversion, preferably for two offset printing machines arranged in tandem. According to the invention, two conveyor belt arrangements, such as invertor apparatus 50 and belt conveyor 26, extend parallel to one another and are disposed one above the other, so that the adjacent runs of these two belt arrangements form a gap (35), in which the sheets can be fed by the belt conveyor (26) from one machine (3) toward another machine (5). Sheet grippers (58) are disposed on the belt (56) of the invertor apparatus (50), closing in the vicinity of the run remote from the belt conveyor (26) and opening in the vicinity of the run oriented toward the belt conveyor (26). The two conveyor belt arrangements (50, 26) are adjustable in common such that the sheets emerging from the first machine (3) are fed either underneath the grippers (58) of the run of the invertor apparatus (50) remote from the belt conveyor (26) or onto the run of the belt conveyor (26) oriented toward the invertor apparatus (50).

7 Claims, 4 Drawing Sheets

SHEET FEEDER AND INVERTER APPARATUS FOR SHEET-PROCESSING MACHINES, PREFERABLY FOR TWO OFFSET PRINTING MACHINES DISPOSED IN TANDEM

FIELD OF THE INVENTION

The present invention relates to a sheet feeder and inverter apparatus for sheet-processing machines for selective operation with or without inverting the sheets, preferably for two offset printing machines disposed in tandem.

BACKGROUND OF THE INVENTION

Sheet feeder and inverter apparatus is already known in many variant forms in the prior art. As a rule, the ability to invert the sheets can be switched on and off, so that the sheets to be processed in any machines can be either processed twice on one side or successively on both sides, or in the case of printing machines can be so printed.

A substantial disadvantage of such known feeder and inverter apparatus is that they are either structurally too complicated and hence expensive, or that they cannot operate fast enough, so that high-speed offset printing machines, for example, which are capable of processing up to 25,000 sheets per hour, cannot be run at their maximum rate.

OBJECT AND SUMMARY OF THE INVENTION

It is accordingly the object of the invention to disclose a sheet feeder and inverter apparatus for the aforementioned sheet-processing machines that does not have the above disadvantages.

This is attained by providing two conveyor belt arrangements extending parallel to one another and with one disposed above the other. Adjacent runs of the two belt arrangements form a gap in which the sheets can be moved by the one conveyor belt arrangement (belt conveyor) from one machine toward another machine. Sheet grippers, disposed on the belt of the inventor apparatus, close in the vicinity of the run remote from the belt conveyor and open in the vicinity of the run oriented toward the belt conveyor. The two conveyor belt arrangements are adjustable in common in such a manner that the sheets emerging from the first machine are fed either underneath the grippers of the run of the inventor apparatus remote from the belt conveyor or on the run of the belt conveyor oriented toward the inventor apparatus. These provisions permit the selective operation of the apparatus with or without inversion of the sheets, and thereby produce the desired objective by using simple means.

The belt conveyor is advantageously drivable at a substantially lower circumferential speed than the inverter apparatus. Since the inverter apparatus must revolve at a circumferential speed that corresponds to the operating speed of the machines, it is thereby possible to allow the sheets fed to the second machine to arrive at a very much slower speed, which makes them substantially easier to process. Since the sheets are deposited on the belt conveyor in an overlapping manner, the total throughput of sheets nevertheless remains the same.

Because the belt conveyor is subjected to suction via suction chambers on the side remote from the inverter apparatus, the sheets deposited on the belt conveyor are reliably grasped.

Because the grippers are opened or closed on the belt of the inverter apparatus by their meeting the associated deflection roller, no separate control means are required for actuating the grippers.

A stop provided in the vicinity of the deflection roller is secured in a stationary manner and during inversion operation protrudes into the gap between the conveyor belt devices and thus stops the sheets that are released at the deflection roller.

In this way, the reversal of movement of the sheets that are to be processed takes place at a precisely defined location, which contributes to supplying the sheets to the second machine at the same relative position each time.

A preferred exemplary embodiment of the invention will be described below, with reference to the accompanying drawings.

DESCRIPTION OF THE PREFERRED EMBODIMENT

Figure 1:
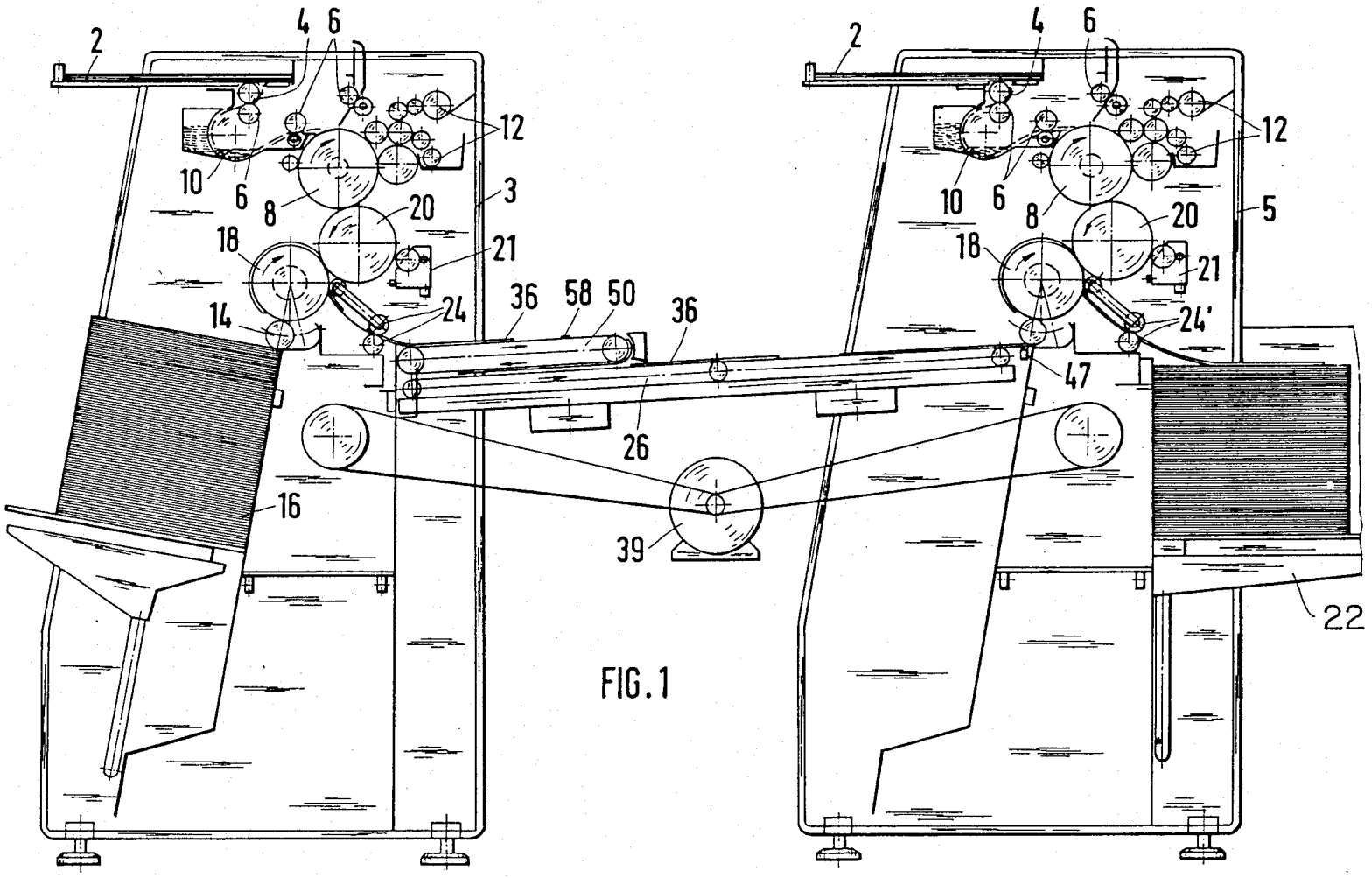
FIG. 1 shows the substantial elements of two offset printing machines disposed one after the other, which are connected to one another via the apparatus according to the invention for printing sheets in succession.

The two printing machines 3, 5 shown in FIG. 1 and disposed one after the other are highly modern offset printing machines with automatic plate changing apparatus.

Each machine has a stacking table 2 for the supply of plates, a plate individualizing device 4 for taking the plates from the stacking table, and a plate transporting and guiding device 6, which guides the new plate that is to be applied onto the form cylinder 8 of the offset printing machine from the separating device through a fixative container and directs it to the form, cylinder and guides the previously used plate from the form cylinder to a repository, not shown. An inking and moistening mechanism 12 acts on the form cylinder in a known manner, inking the plates on the form cylinder in a known manner.

The sheets that are to be printed are removed from a stacking table 16 by known means, such as a suction roller 14 that shuttles back and forth, and delivered to the counter-pressure cylinder 18, whereupon they are printed as they pass in between the counter-pressure cylinder 18 and the rubber blanket or offset cylinder 20. From there, in the case of the machine shown on the left in FIG. 1, the printed sheets are delivered to the feeder and inverter apparatus according to the invention, while in the case of the printing machine shown on the right in FIG. 1 the sheets printed twice on one side or once on both sides are set aside on a lowerable receiving table 22.

In the vicinity of the offset cylinder 20, the associated washing mechanism 21 is provided, with which the printing ink is removed from this cylinder as needed.

In FIG. 1 (as in FIG. 3), the feeder and inverter apparatus is shown in an operating state which includes inversion of the printed sheets, so that they can be printed on the other, as yet unprinted side in the second machine. For the sake of simplicity, however, the construction will first be explained in terms of an operating state shown in FIG. 2, that is, a mode of operation in which the printed sheets are not inverted.

Directly following the pair of delivery rollers 24 of the first printing machine—as viewed in the direction of movement of the printed sheets—is an elongated belt conveyor 26, which comprises a number of endless elastic belts 28 disposed parallel to one another (as well as to the plane of the drawing) and having high coefficients of friction. These belts 28 are guided over two deflection rollers 30 and 32 at the beginning and end of the elongated belt conveyor 26, and as needed additional support rollers 34 are distributed over the length of this conveyor. One support and drive roller is shown in the middle at 38. The conveyor embodied in this manner functions quite similarly to a conventional conveyor belt; that is, the printed sheets 36 deposited on its top and overlapping one another to a variable extent as needed are conveyed from the first printing machine (on the left) to the second printing machine (on the right), at a speed that depends on the circumstances of a particular situation and which will be discussed at greater length below. The conveyor need not comprise individual endless belts 28 (of approximately circular cross section) disposed parallel to one another; instead, it is quite conceivable for one coherent wide belt—for example, one with large holes or having a mesh-like structure—to be used. Naturally an essential factor here is that the individual belts be operated at the same speed, and the drive of the belt conveyor 26 can be effected either centrally, with the middle support and drive roller 38, via the main motor 39, which at the same time also drives the two printing machines 3, 5 synchronously, or alternatively—and as shown—by means of a separate regulatable drive motor 40, which for example acts upon the deflection roller 32 at the end of the conveyor 26 and drives only the belt conveyor 26, while the main motor 39 drives the inverter apparatus 50 and the two printing machines 3, 5.

So that the printed sheets deposited loosely on the top of the conveyor will be compulsorily moved forward, a plurality of large suction chambers 42 are disposed directly beneath the belt conveyor 26 and are subjected to a vacuum via suitable means. These suction chambers 42 have openings 44 pointing toward the top, that is, in the direction of the conveyor 26, resulting in a considerable flow of air toward the suction chambers; via the large surface area of each printed sheet 36 deposited on the conveyor, the result is a more than adequate pressing force that presses the printed sheets against the conveyor, or its belts 28, which have a high coefficient of friction. Thus the printed sheets are fixed on the conveyor belt or on the belts of the conveyor and are compulsorily moved toward the second printing machine, where the front edge of each printed sheet finally strikes against a stop 46 serving as a front marker of the second printing machine. In the course of the conveyor and preferably at its end, the printed sheets are also made flush at the sides, if this is at all necessary. In the vicinity of the aforementioned stop 46 on the second printing machine, that is, at its front marker, the fed sheets are delivered to the counter-pressure cylinder 18' of the second printing machine in a known manner by a suction roller 14' that shuttles back and forth.

In the vicinity of the aforementioned stop 46 (front marker of the second printing machine), a monitoring device is provided, for instance in the form of a reflex head 47. On the one hand, this device monitors the correct timing and spacing of the entry of the sheets to the machine 5, and on the other hand, it controls the switching on of the offset cylinder 20 of the machine 5 whenever a sheet is present at the instant an inquiry is made.

It will be appreciated that with the feeder apparatus described thus far, the printed sheets emerging from the first printing machine have not yet been inverted. Instead, the sheets printed on one side in the first machine are printed on the same side in the second machine, for instance with a different color.

The ratio of the circumferential speed of the cylinder to the speed of the conveyor belt determines the extent of overlapping of the sheets resting on the conveyor. The functional reliability of the apparatus increases in inverse ratio to the substantially reduced speed on the conveyor belt.

Figure 2:
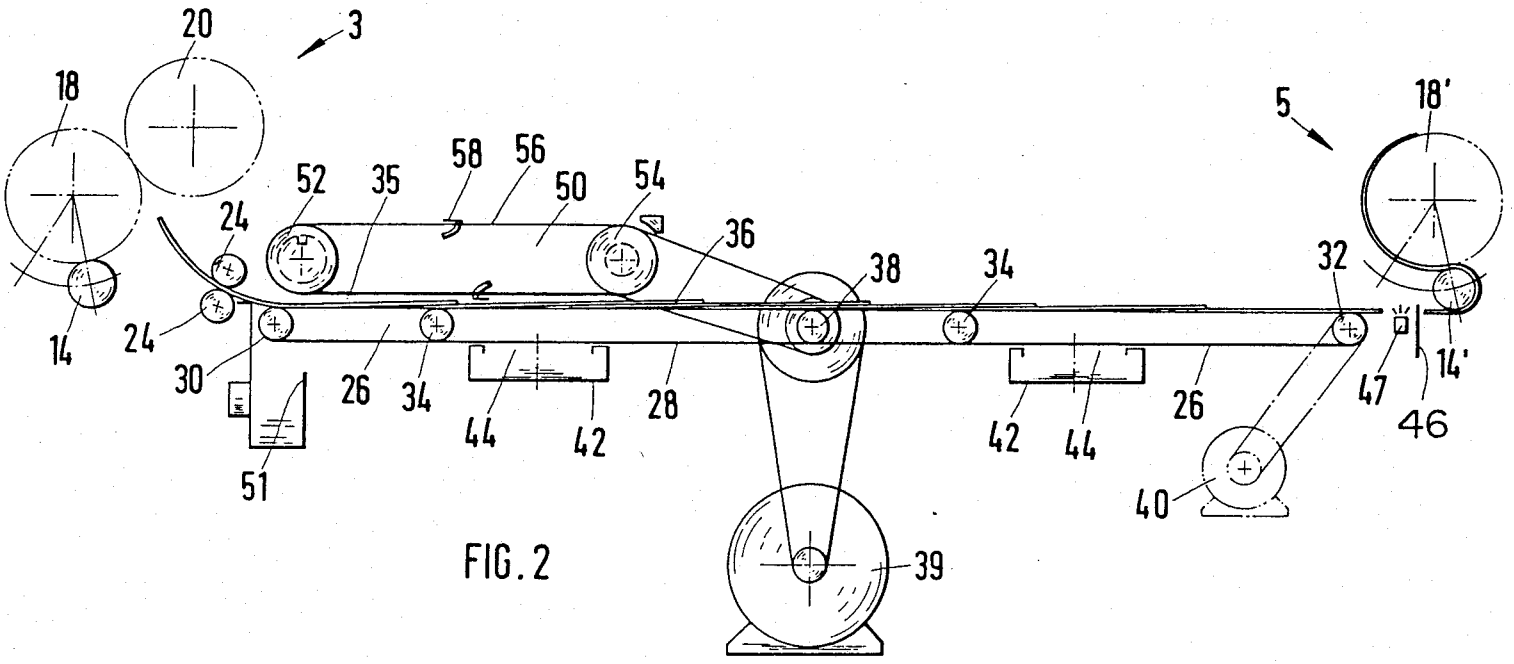
FIGS. 2 and 3 show different operating states of the apparatus according to the invention, without inversion of the sheet delivered to the second printing machine and with such inversion, respectively.

In the mode of operation represented by FIG. 2 (without inversion of the sheets) the printed sheets emerging from the first printing machine are deposited in a replicable manner on the conveyor belt because of the provision that the printed sheet emerging from the first printing machine is not released by the pair of delivery rollers 24 until the vacuum acting on the conveyor 28 has pressed it so strongly against the conveyor belt that it is fixed there.

The elements in the construction that in combination with the conveyor 26 already described lead to a mode of operation in which the printed sheets are inverted will now be described, referring to FIGS. 3–5. In the exemplary embodiment shown, the conveyor 26 is embodied in its left-hand half such that along with the suction chamber or chambers 42 located beneath it, it is pivotable about the middle support and drive roller 38. It will be readily understood that there is certainly no requirement that only half the belt conveyor must be pivotable. Any arbitrary fraction of the belt conveyor, or even the entire belt conveyor, could equally well be pivotable, for example about the deflection roller 32, lowerable, or otherwise adjustable on the second machine 5.

Figure 3:
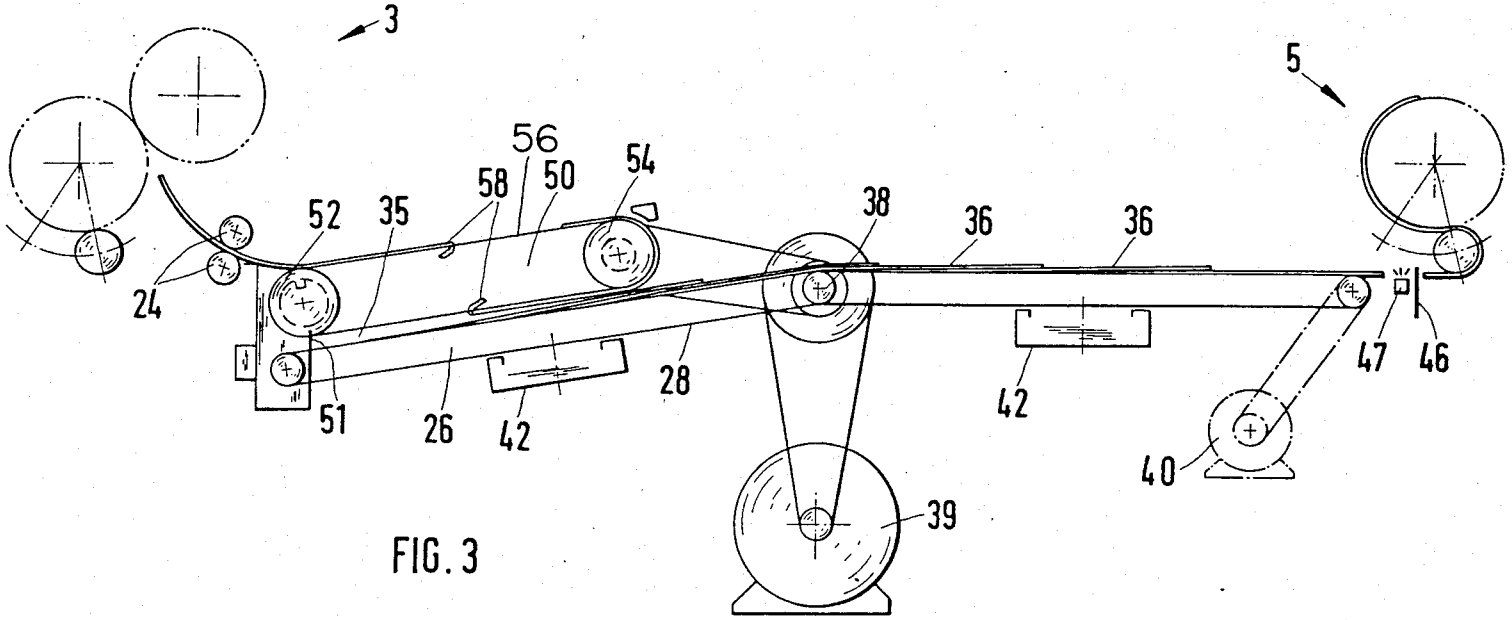

As shown in FIG. 3, a further conveyor-belt-like apparatus, hereinafter called the inverter apparatus 50, is located immediately above the pivotable (left-hand) portion of the belt conveyor 26 described above. The axes of the deflection rollers 52, 54 of this inverter apparatus 50 extend axially parallel with the deflection rollers 30, 32, 38 of the belt conveyor 26, and just like the belt 28 of the belt conveyor 26 the belt or belts 56 of this inverter apparatus are driven in a clockwise direction, although in the case of the inverter apparatus 50 this is always done at a circumferential speed equal to only the speed at which the printed sheet emerges from the first printing machine 3, that is, to the printing speed of the two printing machines 3, 5, which is always identical.

The details of the construction of the inverter apparatus 50 will be discussed below, referring to FIGS. 4 and 5. At this point it should be noted that the revolving belts 56 of the inverter apparatus are embodied as positively engaged toothed belts having openable grippers 58, the grippers being secured to belts 56 at spaced apart locations from one another in the circumferential direction by a distance that corresponds to one revolution of a cylinder of the printing machine; it is entirely possible for each of the belts 56 of the inverter apparatus 50 to be equipped with only a single gripper 58 in the circumferential direction. In that case, the circumferential length of the belt or belts 56 is equivalent to the cylinder circumference of the printing machine.

As shown in FIG. 3, the belt conveyors 26 and the inverter apparatus are lowered or pivoted in common about the middle roller 38 of 26 by a distance such that the printed sheet emerging from the first printing machine 3 is just guided to the beginning of the upper run of the inverter apparatus 50, in such a manner that the front edge of the printed sheet is fed under the gripper 58 of the inverter apparatus that is closing at this point. The inverter apparatus operates at a circumferential speed that is exactly equivalent to the delivery speed of the printed sheet from the first printing machine 3, so that the entire sheet is drawn from the first printing machine and wrapped around the deflection roller 54 of the inverter apparatus—without the gripper 58 coming open during this process. As a result, the top side of the sheet emerging from the printing machine is inverted to face downward, since the printed side of the printed sheet, after reaching the lower run of the inverter apparatus (in FIG. 3) points downward or in other words toward the conveyor 26. As soon as the gripper 58 secured to the conveyor belt 56 of the inverter apparatus meets the deflection roller 52 at the end of the lower run (that is, the end in the circumferential direction of the belt), this gripper opens and releases the front edge of the printed sheet, which now has the previously produced printed image on its lower side, that is, the side facing the conveyor 26. The front edge of the thus-released, inverted printed sheet then runs up against a stop 51, at the end of the gap formed by the upper run of the belt conveyor 26 and the lower run of the inverter apparatus 50. As a result, the printed sheet is stopped, and the suction generated by the suction chambers 42 draws it against the belt conveyor 26, so that the printed sheet is carried along in the opposite direction by the belt conveyor having a high coefficient of friction. Here again, as already explained in connection with FIG. 1, the printed sheets deposited on the belt conveyor come to overlap one another.

The stop 51 is firmly disposed on the first printing machine 3 on a crosspiece. As a comparison of FIGS. 1 and 2 shows, when the inverter and feeder apparatus 50/26 has been pivoted downward as in FIG. 3, the stop 51 extends across the gap 35 between the lower and upper runs of the inverter apparatus 50 or belt conveyor 26, so that the sheets released by the gripper 58 are stopped in their movement, and after being lowered onto the belt conveyor 26 are fed in the opposite direction, that is, toward the second printing machine 5.

With the inverter and feeder apparatus 50/26 pivoted upward as in FIG. 2, the upper end of the stop 51 is located markedly below the aforementioned gap, so that the sheets emerging from the machine 3 are simply deposited on the conveyor 26 and moved toward the second machine 5.

From the above explanations of FIGS. 2 and 3. it is apparent that based on the contruction shown and with simple means, a feeder device having selective inversion of the printed sheets is disclosed for a tandem arrangement, known per se, of two printing machines. A particularly advantageous feature of this feeder and inverter apparatus according to the invention is the fact that a substantially higher throughput of printed sheets can be inverted than was previously possible. With conventional inverter pockets, a maximum throughput of only about 8,000 sheets per hour was possible, while with the construction disclosed herein up to 25,000 printed sheets per hour can be processed.

Figure 5:
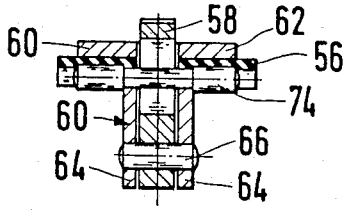
FIG. 5 is a section taken along the line A--D of FIG. 4.
Figure 4:
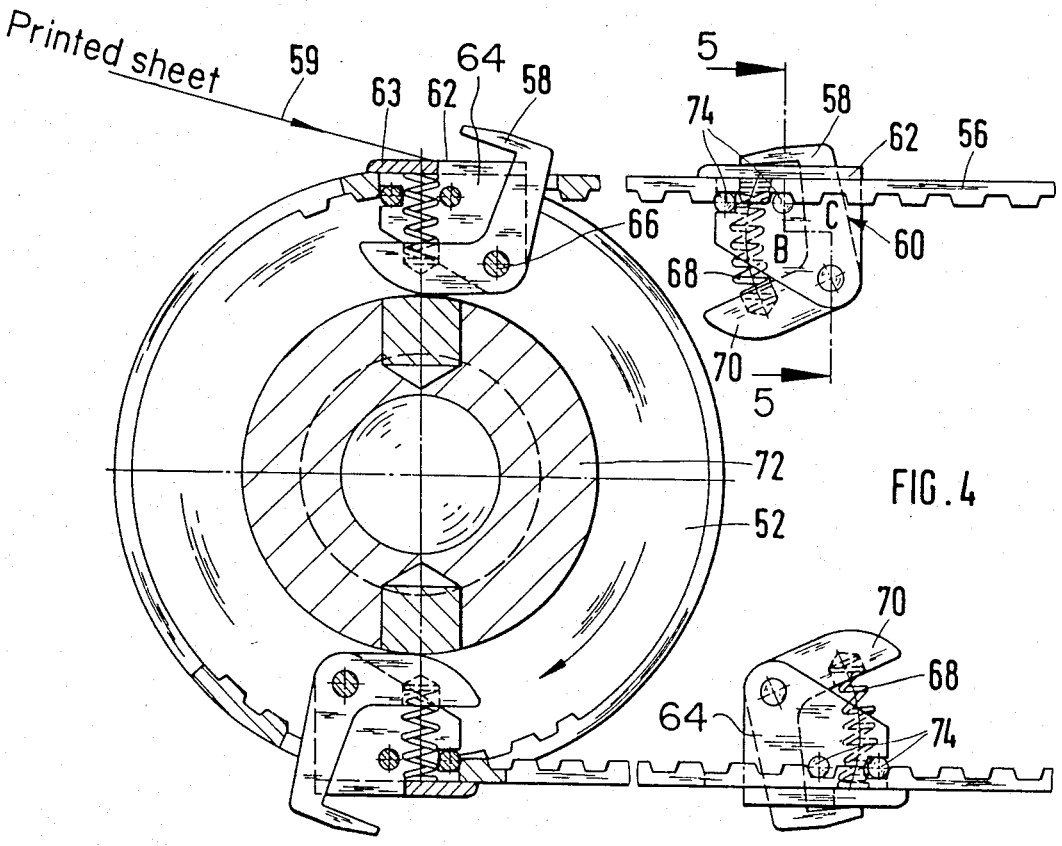
FIG. 4 shows an example of a structural embodiment of the inverter apparatus of FIGS. 1–3.

FIGS. 4 and 5 show details of the construction of the conveyor-belt-like inverter apparatus, the principles of which have been discussed above. FIG. 4 shows only the left-hand end as seen in FIGS. 1–3 and a portion of the course from there of the belt of this inverter apparatus. In the preferred exemplary embodiment described below, two toothed belts (belt 56) disposed beside one another parallel to the plane of the drawing are fastened with the aid of two deflection rollers or gear wheels each, of which only one deflection roller 52 is shown in FIG. 4, along with part of the belt 56.

As shown in FIG. 4, the belts 56 of the inverter apparatus 50 are embodied as toothed belts, and the associated deflection rollers 52/54 are embodied as corresponding gear wheels. However, other forms of belts and deflection rollers are also possible. As FIGS. 4 and 5 show, the toothed belt 56 has a centrally disposed recess at certain points along its longitudinal extension, into which recess the gripper mechanism of the gripper 58 can be removably inserted. The gripper mechanism has an approximately T-shaped support body 60 provided with a central recess; this body comprises a support plate 62/63 disposed on the top of the toothed belt 56 and two middle parts 64 extending at right angles to the support plate, which between them receive the gripper 58, which some distance away from the support plate 62/63 or from the toothed belt 56 is penetrated by a hinge pin 66, which is supported in the two middle parts 64. The hook-like gripper 58 is accordingly pivotable about the hinge pin 66, and in the gripping position the hook-like end of the gripper that protrudes upward past the support plate 62/63 and past the top of the toothed belt 56 rests on the uninterrupted part 63 of the support plate 62. A compression spring 68 is fastened between the support plate 62, 63 and a cam-lever-like extension 70 of the hook-like gripper 58. By means of this compression spring 68, the gripper 58 is normally pivoted into its clamping or gripping position, which it assumes for the entire course of the upper and lower run of the deflection apparatus and while passing around the deflection roller 54. Only when the gripper mechanism is passing around the deflection roller or gear wheel 52 does the gripper assume the open position, as shown in FIG. 4, doing so because the cam-like extension 70 strikes the middle part 72, which has a greater diameter than does the central portion of deflection roller 54. This means that both the deflection roller 54 and the deflection roller 52 have a groove-like recess in their central planes, which is approximately equivalent to the width of the lower part of the gripper mechanism (see FIG. 5); however, the groove-like recess in the deflection roller 52 is not as deep as in the deflection roller 54, so that the gripper mechanism does not open at the deflection roller 54. The depth of the recess in the deflection roller 54 is indicated by a broken line within roller 52 as shown in FIG. 4.

The gripper mechanism is advantageously secured on the toothed belt 56, by means of two securing pins 74 passed therethrough, in such a way that it can be readily released. After these securing pins 74 are removed the gripper mechanism in FIG. 5 can be simply lifted upward out of the recess in the toothed belt 56. For the sake of better locking on the middle parts 64 of the T-shaped support body 60, these pins 74 are provided in the middle with a section of reduced diameter, as is clearly shown in FIG. 5.

In the upper left of FIG. 4, a gripper mechanism is shown that is just beginning to leave the deflection roller 52 and thus is initiating the process of closing the gripper 58. At the same point, the path of the printed sheet that is emerging from the first printing machine 3 is represented by an arrow 59. The printed sheet meets the plate 62/63 at an acute angle on the upper run of the toothed belt 56. As a result, any waviness on the front edge of the printed sheet can be compensated for, since the sheet thus aligns itself on the plate 62/63. Since the speed of the toothed belt 56 and the operating speed of the printing machine are adapted to one another, the sheet that is to be gripped is fed to the toothed belt 56 or to the support plate 62, 63 at a speed such that the differential speed is zero, or virtually zero. Since as viewed in the direction of movement of the toothed belt 56 the hinge pin 66 is located in front of and below (in FIG. 4) the point at which the sheet meets the support plate 62, 63, the hook-like end of the gripper 58 that protrudes upward past the toothed belt 56 moves backward relative to the toothed belt 56 as it closes, or in other words contrary to the direction of movement of the toothed belt, so that secure clamping of the front edge of the printed sheet arriving from the first printing machine is attained.

I claim:

1. A sheet feeder and inventor apparatus for feeding sheets between the discharge of a first sheet processing machine and the entry of a second sheet processing machine and for selective operation with or without inversion during such feeding comprising first and second conveyor belt system respectively positioned so that each extends parallel to the other and are disposed one above the other defining a gap therebetween in which the sheets can be fed by one of said first or second conveyor belt systems from said first machine in the direction of said second machine; said first conveyor belt system being the upper most one of said conveyor belt systems and including a plurality of sheet grippers which close in the vicinity of said first conveyor belt system remote from the second and lowermost of said conveyor belt systems and open in the vicinity of said first conveyor belt system oriented toward said second conveyor belt system; and wherein said first and second conveyor belt systems, respectively, include separate entry and exit paths with the entry path of each being alternately locatable relative to the discharge of said first machine, said first and second conveyor belt systems being pivotally movable relative to said first machine and being adjustable in common in such a manner that the sheets emerging from said first machine are fed either onto said first conveyor belt system and underneath said sheet grippers remote from said second conveyor belt system or directly onto said second conveyor belt system.

2. Apparatus as in claim 1, wherein said second conveyor belt system is a belt conveyor and said first conveyor belt system is an inventor apparatus, said belt conveyor being drivable at a circumferential speed substantially lower than that of said inventor apparatus.

3. Apparatus as in claim 2, further including suction means for providing suction to said belt conveyor at a point on the side remote from said inventor apparatus.

4. Apparatus as in claim 2, wherein said inventor apparatus includes a deflection roller positioned adjacent said first sheet processing machine and said sheet grippers of said inventor apparatus are opened by coming into engagement with said deflection rollers.

5. Apparatus as in claim 4, further including sheet stop means positioned adjacent said deflection roller, said sheet stop means being secured in a stationary manner, whereby during inversion said sheet stop means protrudes into said gap so that each sheet released by said sheet grippers at the deflection roller is stopped at a predetermined location.

6. Apparatus as in claim 1, wherein said invertor apparatus has a length that is shorter than the length of said belt conveyor.

7. An apparatus as in claim 1, wherein the pivotal mount for said first and second conveyor belt systems is positioned substantially centrally along the length of said belt conveyor.

* * * * *

UNITED STATES PATENT AND TRADEMARK OFFICE

CERTIFICATE OF CORRECTION

PATENT NO. : 4,792,132

DATED : December 20, 1988

INVENTOR(S) : Hans J. Jahme

It is certified that error appears in the above-identified patent and that said Letters Patent is hereby corrected as shown below:

ON THE TITLE PAGE

Item [75] Inventor(s), change "Weisbaden" to --Wiesbaden--.

Item [73] Assignee, change "Rotoprint" to --Rotaprint--.

IN THE ABSTRACT:

Line 1, change "invertor" to --inverter--.

Line 5, change "invertor" to --inverter--.

Line 12, change "invertor" to --inverter--.

Line 18, change "invertor" to --inverter--.

Line 20, change "invertor" to --inverter.

UNITED STATES PATENT AND TRADEMARK OFFICE

CERTIFICATE OF CORRECTION

PATENT NO. : 4,792,132

DATED : December 20, 1988

INVENTOR(S) : Hans J. JAHME

It is certified that error appears in the above-identified patent and that said Letters Patent is hereby corrected as shown below:

Column 7, line 31, change "inventor" to --inverter--.

Column 8, line 18, change "inventor" to --inverter--;

line 21, change "inventor" to --inverter--;

line 24, change "inventor" to --inverter--;

line 25, change "inventor" to --inverter--;

line 28, change "inventor" to --inverter--;

line 37, change "invertor" to --inverter--.

Signed and Sealed this

Twenty-eighth Day of January, 1992

*Attest:*

HARRY F. MANBECK, JR.

*Attesting Officer*

*Commissioner of Patents and Trademarks*